US010020141B2

(12) United States Patent
Chen

(10) Patent No.: US 10,020,141 B2
(45) Date of Patent: Jul. 10, 2018

(54) KEY DEVICE AND LIGHT GUIDING MEMBRANE SWITCH

(71) Applicant: Chicony Electronics Co., Ltd., New Taipei (TW)

(72) Inventor: Chia-Hsin Chen, New Taipei (TW)

(73) Assignee: Chicony Electronics Co., Ltd., New Taipei (TW)

( * ) Notice: Subject to any disclaimer, the term of this patent is extended or adjusted under 35 U.S.C. 154(b) by 20 days.

(21) Appl. No.: 15/348,075

(22) Filed: Nov. 10, 2016

(65) Prior Publication Data

US 2018/0012714 A1 Jan. 11, 2018

(30) Foreign Application Priority Data

Jul. 5, 2016 (TW) ..... 105210093 U

(51) Int. Cl.

| | |
|---|---|
| ***H01H 9/00*** | (2006.01) |
| ***H01H 13/83*** | (2006.01) |
| ***H01H 13/7065*** | (2006.01) |
| ***H01H 13/703*** | (2006.01) |

(52) U.S. Cl.

CPC ..... *H01H 13/83* (2013.01); *H01H 13/703* (2013.01); *H01H 13/7065* (2013.01); *H01H 2219/06* (2013.01); *H01H 2219/062* (2013.01)

(58) Field of Classification Search

CPC .. H01H 13/83; H01H 13/703; H01H 13/7065; H01H 2219/06; H01H 2219/062; H01H 3/00; H01H 3/02; H01H 3/12; H01H 13/00; H01H 13/14; H01H 13/20; H01H 13/50; H01H 13/52; H01H 13/70; H01H 2003/12; H01H 2009/16; H01H 2009/161; H01H 2009/164; H01H 2009/18; H01H 2009/182; H01H 2009/183; H01H 2009/186; H01H 2219/00; H01H 2219/014; H01H 2219/018; H01H 2219/036; H01H 2219/039; H01H 2221/00; H01H 2221/002; H01H 2221/006

USPC ..... 200/5 A, 314

See application file for complete search history.

(56) References Cited

U.S. PATENT DOCUMENTS

| | | | | |
|---|---|---|---|---|
| 2005/0056531 | A1* | 3/2005 | Yu | H01H 13/83 200/310 |
| 2011/0272262 | A1* | 11/2011 | Chen | H01H 13/83 200/5 A |
| 2013/0087440 | A1* | 4/2013 | Huang | H01H 3/125 200/314 |

* cited by examiner

*Primary Examiner* — Anthony R. Jimenez
(74) *Attorney, Agent, or Firm* — Muncy, Geissler, Olds & Lowe, P.C.

(57) ABSTRACT

A key device includes a bottom plate, a light guiding membrane switch, and a keycap. The light guiding membrane switch is disposed on the bottom plate and includes a lower membrane layer, an upper membrane layer, a light guiding spacing layer, a reflective layer, and an adhering layer. The upper membrane layer is disposed above the lower membrane layer and farther from the bottom plate than the lower membrane layer. The light guiding spacing layer is disposed between the lower membrane layer and the upper membrane layer and includes opposite upper and lower surfaces. The reflective layer is securely fastened on the upper surface. The adhering layer is adhered between the reflective layer and the upper membrane layer, and a position and a shape of the adhering layer correspond to a position and a shape of the reflective layer.

18 Claims, 6 Drawing Sheets

KEY DEVICE AND LIGHT GUIDING MEMBRANE SWITCH

CROSS-REFERENCE TO RELATED APPLICATION

This non-provisional application claims priority under 35 U.S.C. § 119(a) to Patent Application No. 105210093 filed in Taiwan, R.O.C. on Jul. 5, 2016, the entire contents of which are hereby incorporated by reference.

BACKGROUND

Technical Field

The instant disclosure relates to a keyboard component, in particular, to a key device and a light guiding membrane switch.

Related Art

Keyboards are common input devices used along with electronic devices such as personal computers, laptops, mobile phones, tablets, etc. In addition, light-emitting keyboards are developed for those circumstances having insufficient light.

Currently, the market available light-emitting keyboard uses a backlight module as its light source. The backlight module is on the bottom of each of the keys, so that a light source like an LED in the backlight module emits light to a light guiding plate of the backlight module, and the light is then guided upwardly by the light guiding plate from the bottom of each of the keys. However, the light generated by the backlight module has to pass through the bottom plate, the membrane switch, and the scissor structure to arrive at the keycap. As a result, the light intensity may be reduced during the transmission. In addition, the backlight module increases the overall thickness of the keyboard, contrary to the light-and-thin trend.

SUMMARY

In view of these issues, in one embodiment, a key device is provided. The key device comprises a bottom plate, a light guiding membrane switch, and a keycap. The light guiding membrane switch is on the bottom plate. The light guiding membrane switch comprises a lower membrane layer, an upper membrane layer, a light guiding spacing layer, a reflective layer, and an adhering layer. The upper membrane layer is disposed above the lower membrane layer and farther from the bottom plate than the lower membrane layer. The light guiding spacing layer is disposed between the lower membrane layer and the upper membrane layer. The light guiding spacing layer comprises an upper surface and a lower surface opposite to the upper surface. The reflective layer is securely fastened on the upper surface of the light guiding spacing layer. The adhering layer is adhered between the reflective layer and the upper membrane layer, and a position and a shape of the adhering layer correspond to a position and a shape of the reflective layer.

In another embodiment, a light guiding membrane switch is provided. The light guiding membrane switch comprises a lower membrane layer, an upper membrane layer, a light guiding spacing layer, a reflective layer, and an adhering layer. The upper membrane layer is disposed above the lower membrane layer. The light guiding spacing layer is disposed between the upper membrane layer and the lower membrane layer. The light guiding spacing layer comprises a lower surface and an upper surface opposite to the lower surface. The reflective layer is securely fastened on the upper surface of the light guiding spacing layer, the adhering layer is adhered between the reflective layer and the upper membrane layer, and a shape and a position of the adhering layer correspond to a shape and a position of the reflective layer.

According to the embodiments of the instant disclosure, the light guiding spacing layer of the light guiding membrane switch can also have a light guiding function, so that the key device does not need additional backlight modules on its bottom, and the overall thickness of the key device can be reduced as well as the energy loss of light can be reduced. Moreover, because the reflective layer is secured on the upper surface of the light guiding spacing layer and the adhering layer is adhered between the reflective layer and the upper membrane layer, light generated by the light guiding spacing layer would not be absorbed by the adhering layer, and the energy loss of light can be further reduced and the luminous efficiency can be improved.

BRIEF DESCRIPTION OF THE DRAWINGS

The disclosure will become more fully understood from the detailed description given herein below for illustration only, and thus not limitative of the disclosure, wherein.

DETAILED DESCRIPTION

Figure 1:
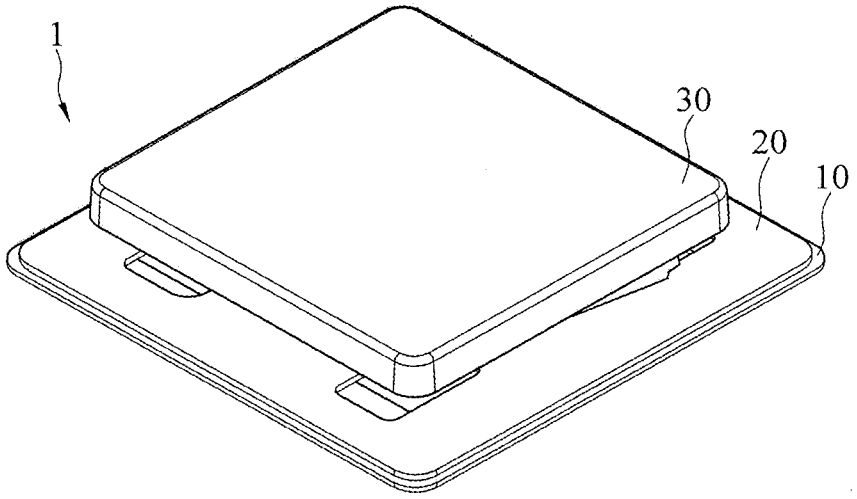
FIG. 1 illustrates a perspective view of a first embodiment of a key device according to the instant disclosure.
Figure 2:
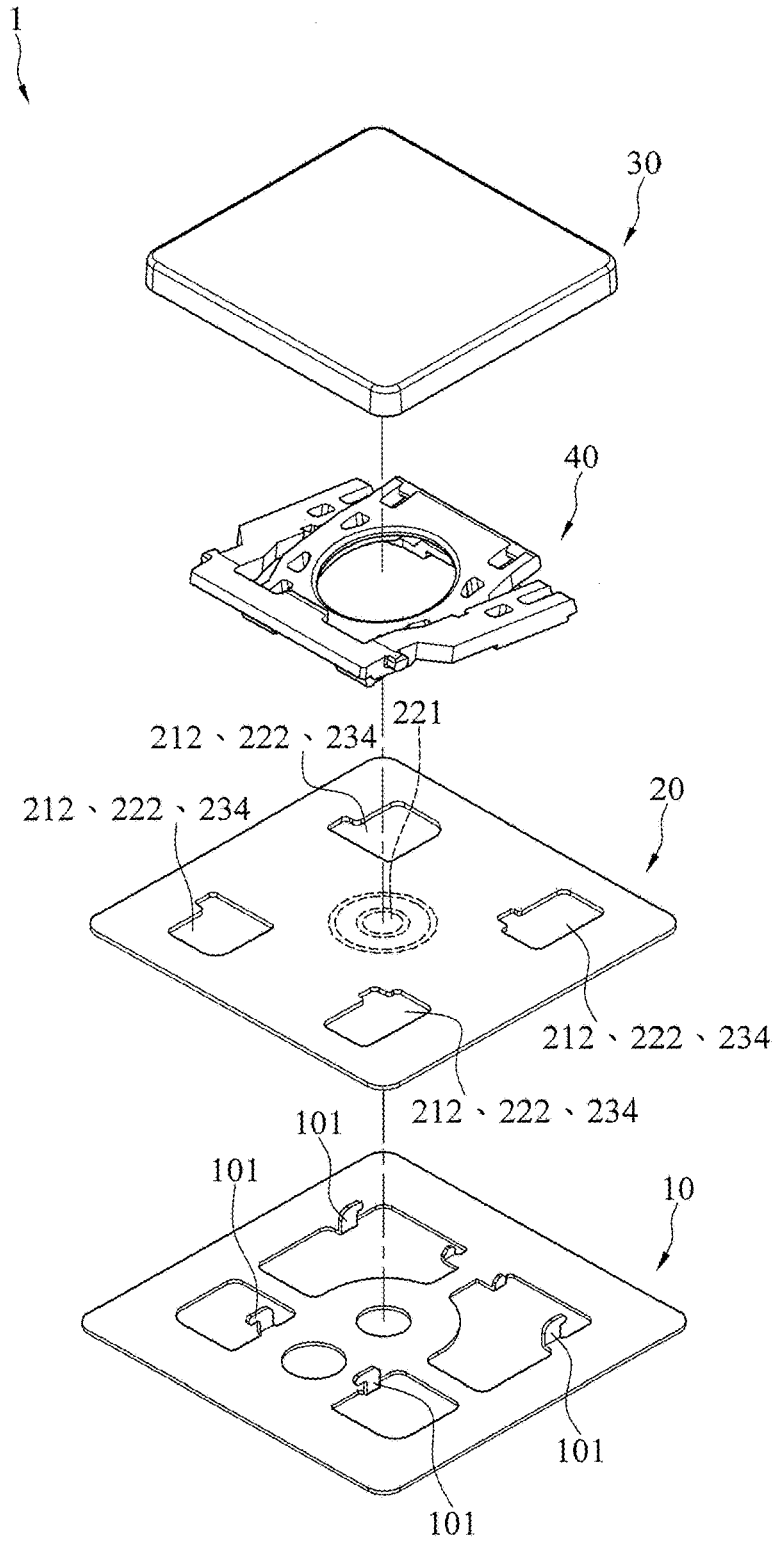
FIG. 2 illustrates an exploded view of the first embodiment of the key device.

FIGS. 1 and 2 respectively illustrate a perspective view and an exploded view of a first embodiment of a key device 1 according to the instant disclosure. In this embodiment, the key device 1 comprises a bottom plate 10, a light guiding membrane switch 20, and a keycap 30. The light guiding membrane switch 20 is disposed between the bottom plate 10 and the keycap 30, and a connecting member 40 (herein, a scissor structure) is pivotally connected between the bottom plate 10 and the keycap 30, so that the keycap 30 can be moved upward and downward with respect to the bottom plate 10.

Figure 3:
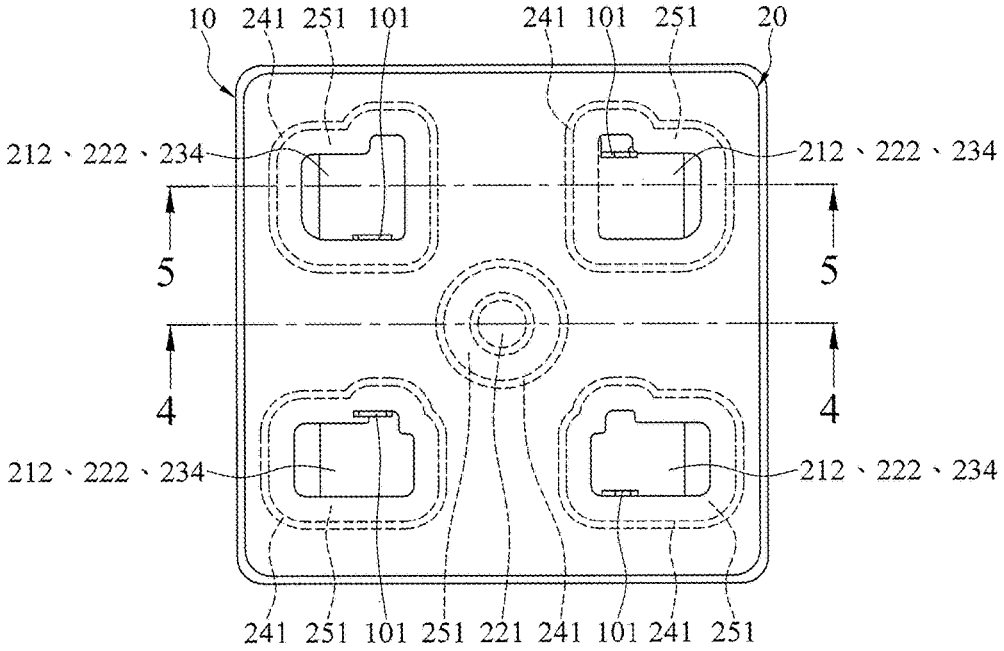
FIG. 3 illustrates a top view of a first embodiment of a light guiding membrane switch according to the instant disclosure.
Figure 4:
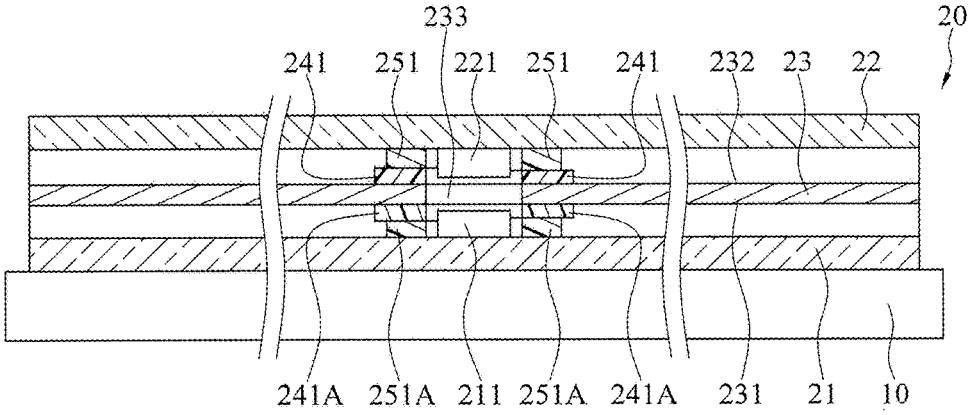
FIG. 4 illustrates a cross sectional view along line 4-4 shown in FIG. 3.
Figure 5:
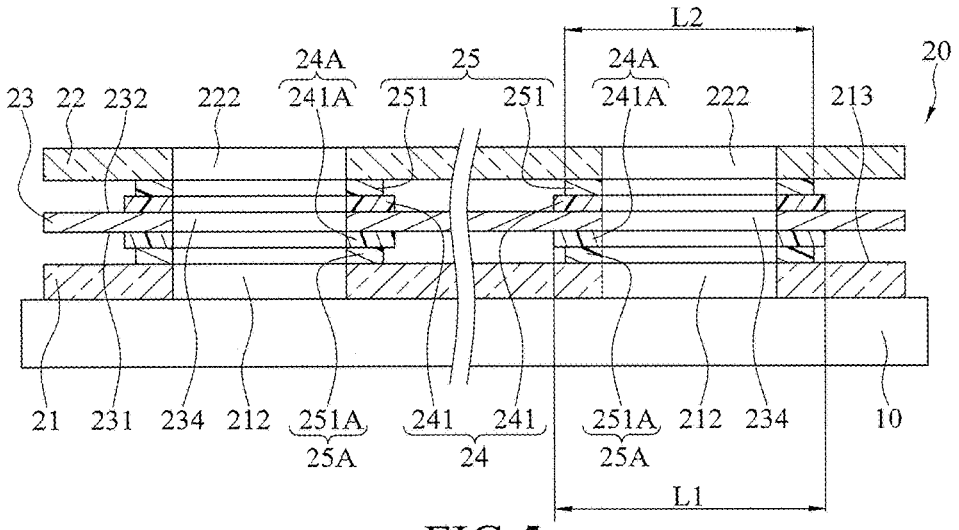
FIG. 5 illustrates a cross sectional view along line 5-5 shown in FIG. 3.

Please refer to FIGS. 3 to 5. FIG. 3 illustrates a top view of a first embodiment of a light guiding membrane switch 20 according to the instant disclosure. FIG. 4 illustrates a cross sectional view along line 4-4 shown in FIG. 3. FIG. 5 illustrates a cross sectional view along line 5-5 shown in FIG. 3. In this embodiment, the light guiding membrane switch 20 is a multilayered membrane structure. The light guiding membrane switch 20 comprises a lower membrane layer 21, an upper membrane layer 22, a light guiding spacing layer 23, two reflective layers 24 and 24A, and two adhering layers 25 and 25A. The reflective layer 24A and the adhering layer 25A are disposed on an upper surface 232 of the light guiding spacing layer 23. The reflective layer 24 and the adhering layer 25 are disposed on a lower surface 231 of the light guiding spacing layer 23. The lower membrane layer 21 is the bottommost layer and stacked on the bottom plate 10, the upper membrane layer 22 is the topmost layer and farther the bottom plate 10 than the lower membrane layer 21, and the light guiding spacing layer 23 is disposed between the lower membrane layer 21 and the upper membrane layer 22. In addition, for the sake of convenience, the thickness of each of the layers of the light guiding membrane switch 20 (i.e., the lower membrane layer 21, the upper membrane layer 22, the light guiding spacing layer 23, the two reflective layers 24 and 24A, and the two adhering layers 25 and 25A) shown in FIGS. 4 and 5 is for illustrative purpose, rather than a limitation of the instant disclosure.

Moreover, as shown in FIGS. 3 to 5, in this embodiment, the lower membrane layer 21 may be made of polyimide, polyethylene terephthalate, or polycarbonate to have transmittancy. In addition, a surface of the lower membrane layer 21 facing the upper membrane layer 21 comprises a first trigger point 211 and a plurality of first through holes 212. In detail, the first trigger point 211 may be a layout pattern formed by metal and provided as a switch, and the first trigger point 211 is formed on the surface of the lower membrane layer 21. Each of the first through holes 212 penetrates top and bottom surfaces of the lower membrane layer 21. In addition, the first through holes 212 are around the first trigger point 211 (as shown in FIG. 3). In other words, each of the first through holes 212 is near to but not in contact with the first trigger point 211. Moreover, each of the first through holes 212 may have round, square, rectangular, trapezoidal, or irregular shapes, and embodiments are not limited thereto. Likewise, the upper membrane layer 22 may be made of polyimide, polyethylene terephthalate, or polycarbonate to have transmittancy. In addition, the upper membrane layer 22 comprises a second trigger point 221 and a plurality of second through holes 222. The second trigger point 221 is located on a surface of the upper membrane layer 22 facing the lower membrane layer 21 and corresponds to the first trigger point 211. In detail, the second trigger point 221 may be a layout pattern formed by metal and provided as a switch, and the second trigger point 221 is formed on the surface of the upper membrane layer 22. Moreover, as shown in FIGS. 3 and 5, each of the second through holes 222 penetrates top and bottom surfaces of the upper membrane layer 22. In addition, the second through holes 222 are around the second trigger point 221 (as shown in FIG. 3). In other words, each of the second through holes 222 is near to but not in contact with the second trigger point 221. Moreover, each of the second through holes 222 may have round, square, rectangular, trapezoidal, or irregular shapes, and embodiment are not limited thereto.

As shown in FIGS. 3 to 5, in this embodiment, the light guiding spacing layer 23 comprises a plurality of via holes 233, 234 (which comprises a via hole 233 at the center of the light guiding spacing layer 23 and several via holes 234 around the via hole 233). Specifically, the lower surface 231 of the light guiding spacing layer 23 faces the lower membrane layer 21, the upper surface 232 of the light guiding spacing layer 23 faces the upper membrane layer 22, and the via hole 233 penetrates the upper and lower surfaces 232, 231 of the light guiding spacing layer 23, and correspond to the first trigger point 211 and the second trigger point 221. Therefore, the first trigger point 211 faces the second trigger point 221 directly and is spaced from the second trigger point 221 by an internal. Accordingly, when the first trigger point 211 or the second trigger point 221 is pressed to come close to each other, a connection is built between the first trigger point 211 and the second trigger point 221 and signals are generated accordingly. In other words, the light guiding spacing layer 23 can separate the lower membrane layer 21 from the upper membrane layer 22, so that the first trigger point 211 and the second trigger point 221 are not in contact with each other and no connection is built between the first trigger point 211 and the second trigger point 221 when the first trigger point 211 or the second trigger point 221 is not pressed.

Figure 6:
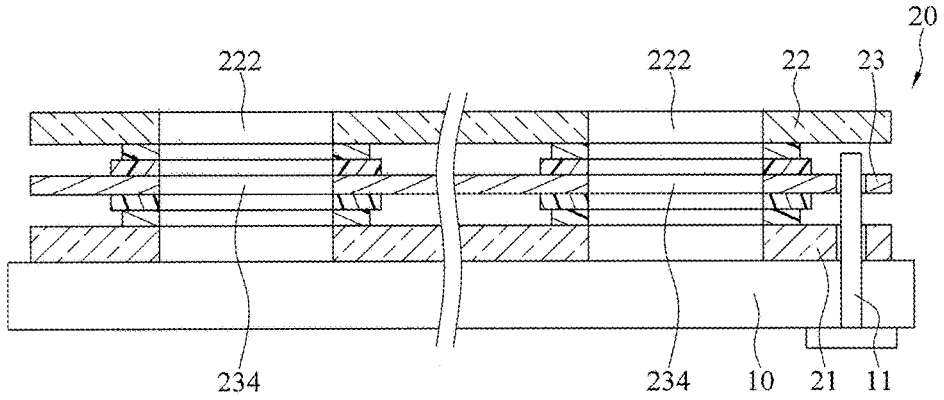
FIG. 6 illustrates a cross-sectional view showing that the first embodiment of the light guiding membrane switch is assembled with a light emitting member.

In addition, the light guiding spacing layer 23 may be substantially a light guide plate and has a light guide function. For example, the light guiding spacing layer 23 may be made of polycarbonate (PC), poly(methyl methacrylate) (PMMA), or glass to have transmittancy, so that after an external light source enters into the light guiding spacing layer 23, the light passing through the light guiding spacing layer 23 can form an area light source. As shown in FIG. 6, a schematic view showing that the first embodiment of the light guiding membrane switch 20 is assembled with a light emitting member 11. In this embodiment, a light emitting member 11 (e.g., an LED) is assembled to the bottom plate 10. The light emitting member 11 is inserted into the light guiding membrane switch 20, and the light emitting member 11 generates light and emits the light to the light guiding spacing layer 23, so that the light can be emitted from the lower surface 231 and the upper surface 232. In some embodiments, the light emitting member 11 may be assembled in the light guiding membrane switch 20 and electrically connected to the lower membrane layer 21 or the upper membrane layer 22. The light emitted from the light emitting member 11 is guided into the light guiding membrane switch 20 via a side portion of the light guiding membrane switch 20 or via a via hole of the light guiding membrane switch 20. Such embodiment is not illustrated.

Accordingly, as shown in FIGS. 2 and 6, the light emitted from the light guiding membrane switch 20 can be transmitted to the keycap 30 through the upper membrane layer 22. Therefore, alphabets, numbers, or symbols on the keycap 30 can emit light and can be presented clearly even under a dark circumstance. Consequently, in this embodiment, the light guiding spacing layer 23 of the light guiding membrane switch 20 can have a light guide function, so that the key device 1 does not need additional backlight modules on its bottom and the overall thickness of the key device 1 can be reduced efficiently. In addition, light emitted from the light guiding spacing layer 23 would not be shielded by the bottom plate 10 so that the energy loss of light can be reduced.

Furthermore, as shown in FIGS. 3 and 5, in this embodiment, each of the first through holes 212 of the lower membrane layer 21 and each of the second through holes 222 of the upper membrane layer 22 correspond to the via holes 234 of the light guiding spacing layer 23. In one embodiment, the shape of each of the first through holes 212 corresponds to the shape of the corresponding via hole 234, and the shape of each of the second through holes 222 corresponds to the shape of the corresponding via hole 234. Moreover, the bottom plate 10 may comprise a plurality of limiting members 101 (e.g., hooks or pivot holes). The limiting member 101 penetrates through the first through hole 212, the via hole 234, and the second through hole 222 in order, and the limiting member 101 is protruding upward, so that the connecting member 40 on the light guiding membrane switch 20 can be connected with the limiting member 101 (as shown in FIG. 2). In other words, the first through hole 212, the via hole 234, and the second through hole 222 are in communication with each other, so that the components of the bottom plate 10 can be protruding from the light guiding membrane switch 20 to allow the connecting member 40 of the light guiding membrane switch 20 connecting with the bottom plate 10.

Please refer to FIGS. 3 to 5 again, in this embodiment, the reflective layer 24 comprises several annular reflective media 241; for example, the annular reflective medium 241 may be a reflective ink (e.g., a light-color ink, wherein the term "light-color" may mean white, pale blue, pale green, pale yellow, pale gray, and the like) or a reflective film. Each of the annular light reflective media 241 are disposed on the upper surface 232 of the light guiding spacing layer 23 and are disposed along the periphery of the via holes 233, 234. Likewise, the reflective layer 24A comprises several annular reflective media 241A. Each of the annular reflective media 241A are disposed on the lower surface 231 of the light guiding spacing layer 23 and are disposed along the periphery of the via holes 233, 234. The adhering layer 25 comprises a plurality of annular adhesive media 251, and each of the annular adhesive media 251 is adhered between the corresponding annular reflective medium 241 and the upper membrane layer 22; likewise, the adhering layer 25A comprises a plurality of annular adhesive media 251A, and each of the annular adhesive media 251A is adhered between the corresponding annular reflective medium 241A and the lower membrane layer 21. Accordingly, the lower membrane layer 21, the upper membrane layer 22, and the light guiding spacing layer 23 can be adhered with each other via the adhering layers 25, 25A. In addition, in this embodiment, because of the reflective layers 24, 24A between the light guiding spacing layer 23 and the adhering layers 25, 25A, light emitted inside of the light guiding spacing layer 23 would not be absorbed by the adhering layers 25, 25A, so that the energy loss of light can be further reduced as well as the luminous efficiency can be further improved. In some embodiments, the reflective layer 24 and the adhering layer 25 are disposed between the upper membrane layer 22 and the light guiding spacing layer 23, and only the adhering layer 25A is disposed between the lower membrane layer 21 and the light guiding spacing layer 23, such embodiments are not illustrated. It is noted that, because the structural strength of the holes (for example, the first through holes 212, the second through holes 222, and the via holes 233, 234) are rather weaker, in one embodiment, the annular reflective media 241, 241A of the reflective layers 24, 24A are disposed along the peripheries of the holes, and the annular adhesive media 251, 251A of the adhering layers 25, 25A are disposed along the peripheries of the holes. Therefore, the light guiding membrane switch 20 can provide with a better structural strength, and liquids or foreign articles can be prevented from entering into the light guiding membrane switch 20, but embodiments are not limited thereto. In some embodiments, the adhering layers 25, 25A may be solid adhering layers or spot adhesive media that are adhered to other portions of the light guiding membrane switch 20, and the shapes and the positions of the reflective layers 24, 24A correspond to the shapes and the positions of the adhering layers 25, 25A.

As shown in FIG. 5, in this embodiment, the covering range of each of the annular reflective media 241, 241A is greater than the covering range of the corresponding annular adhesive medium 251/251A. For example, the cross-sectional width L1 of each of the annular reflective media 241, 241A is preferably greater than the cross-sectional width L2 of the corresponding annular adhesive medium 251, 251A, so that the covering range of each of the annular reflective media 241, 241A is greater than the covering range of the corresponding annular adhesive medium 251/251A. Hence, each of the annular adhesive media 251, 251A and the light guiding spacing layer 23 are completely separated by the corresponding annular reflective medium 241/241A, thus, light would not be absorbed by the annular adhesive media 251, 251A, but embodiments are not limited thereto. In some embodiments, as shown in FIG. 7, for a light guiding membrane switch 20A, the width of each of the annular reflective media 241, 241A may be equal to the width of the corresponding annular adhesive medium 251, 251A.

In one embodiment, the annular adhesive media 251, 251A of the adhering layers 25, 25A may be, but not limited to, light-color media for reflecting light from the reflective layers 24, 24A so as to reduce the energy loss of light and to improve the luminous efficiency, wherein the term "light-color" may be white, pale blue, pale green, pale yellow, pale gray, and the like. In some embodiments, the adhering layers 25, 25A may be transparent layers, so that light revealed from the reflective layers 24, 24A can be further revealed from the adhering layers 25, 25A, and the luminous efficiency can be improved.

Figure 7:
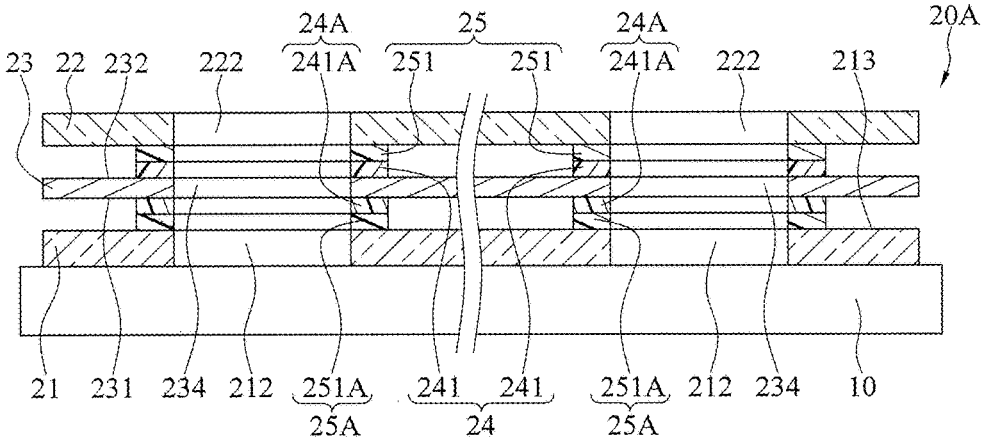
FIG. 7 illustrates a cross sectional view of a second embodiment of the light guiding membrane switch.

As further shown in FIG. 7, in one embodiment, the lower membrane layer 21 further comprises a light reflection layer 213 (for example, a reflective ink or a reflective film) on a surface thereof which faces the light guiding spacing layer 23, so that light revealed from the light guiding spacing layer 23 toward the lower membrane layer 21 can be reflected upward and reused, and light can be collectively emitted from the upper surface 232 of the light guiding spacing layer 23 and transmitted to the keycap 30.

Figure 8:
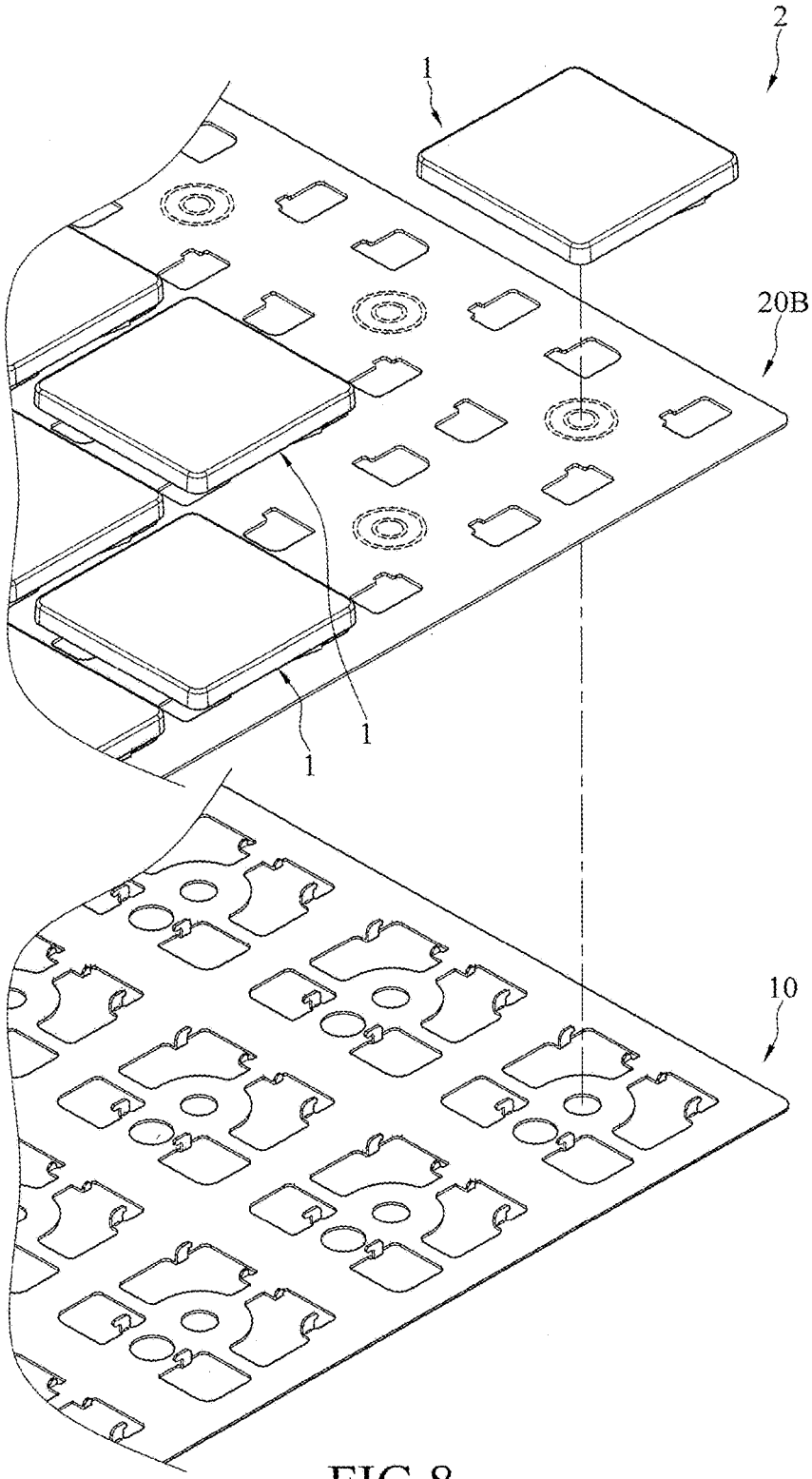
FIG. 8 illustrates an exploded view showing that the light guiding membrane switch is applied to a keyboard.

Please refer FIG. 8, illustrating an exploded view showing that a light guiding membrane switch 20B is applied to a keyboard 2. In this embodiment, a light guiding membrane switch 20B of a keyboard 2 is provided. The keyboard 2 comprises several key devices 1 as mentioned. Hence, the light guiding membrane switch 20B is a membrane switch in a sheet form and is disposed on bottoms of several keycaps 30. In other words, the light guiding membrane switch 20B is an assembly of several aforementioned light guiding membrane switches 20, and the details of the light guiding membrane switch 20B are not described.

According to the embodiments of the instant disclosure, the light guiding spacing layer of the light guiding membrane switch can also have a light guiding function, so that the key device does not need additional backlight modules on its bottom, and the overall thickness of the key device can be reduced as well as the energy loss of light can be reduced. Moreover, because the reflective layer is secured on the upper surface of the light guiding spacing layer and the adhering layer is adhered between the reflective layer and the upper membrane layer, light generated by the light guiding spacing layer would not be absorbed by the adhering layer, and the energy loss of light can be further reduced and the luminous efficiency can be improved.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A key device, comprising:

a bottom plate;

a light guiding membrane switch on the bottom plate, wherein the light guiding membrane switch comprises a lower membrane layer, an upper membrane layer, and a light guiding spacing layer; and a keycap on the light guiding membrane switch;

wherein, the upper membrane layer is disposed above the lower membrane layer and farther from the bottom plate than the lower membrane layer, the light guiding spacing layer is disposed between the lower membrane layer and the upper membrane layer, the light guiding spacing layer comprises an upper surface and a lower surface opposite to the upper surface, a reflective layer is securely fastened on the upper surface of the light guiding spacing layer, an adhering layer is adhered between the reflective layer and the upper membrane layer, and a position and a shape of the adhering layer correspond to a position and a shape of the reflective layer.

2. The key device according to claim 1, wherein the light guiding spacing layer comprises a via hole penetrating the upper and lower surfaces thereof, and the adhering layer and the reflective layer are disposed to the via hole correspondingly.

3. The key device according to claim 2, wherein the adhering layer is an annular adhesive medium disposed along a periphery of the via hole.

4. The key device according to claim 2, wherein a covering range of the reflective layer is equal to, or greater than a covering range of the adhering layer.

5. The key device according to claim 2, wherein the adhering layer is a transparent adhesive medium or a light-color adhesive medium.

6. The key device according to claim 2, further comprising a connecting member for connecting the bottom plate with the keycap, wherein the lower membrane layer comprises a first through hole, the upper membrane layer comprises a second through hole, wherein the first through hole, the second through hole, and the via hole of the light guiding spacing layer correspond to each other, and wherein the bottom plate comprises a limiting member penetrating through the first through hole, the via hole, and the second through hole in order, and the connecting member is connected to the limiting member.

7. The key device according to claim 2, wherein the lower membrane layer comprises a first trigger point, the upper membrane layer comprises a second trigger point corresponding to the first trigger point, and the via hole correspond to the first trigger point and the second trigger point.

8. The key device according to claim 2, wherein the lower membrane layer further comprises a light reflection layer on a surface thereof which faces the light guiding spacing layer.

9. The key device according to claim 2, further comprising a second adhering layer and a second reflective layer, wherein the second reflective layer is securely fastened on the lower surface of the light guiding spacing layer, and the second adhering layer is adhered between the second reflective layer and the lower membrane layer.

10. A light guiding membrane switch, comprising:

a lower membrane layer;

an upper membrane layer disposed above the lower membrane layer;

a light guiding spacing layer disposed between the lower membrane layer and the upper membrane layer, wherein the light guiding spacing layer comprises a lower surface and an upper surface opposite to the lower surface;

a reflective layer securely fastened on the upper surface of the light guiding spacing layer; and an adhering layer adhered between the reflective layer and the upper membrane layer, wherein a position and a shape of the adhering layer correspond to a position and a shape of the reflective layer.

11. The light guiding membrane switch according to claim 10, wherein the light guiding spacing layer comprises a via hole penetrating the upper and lower surfaces thereof, and the adhering layer and the reflective layer are disposed to the via hole correspondingly.

12. The light guiding membrane switch according to claim 11, wherein the adhering layer is an annular adhesive medium disposed along a periphery of the via hole.

13. The light guiding membrane switch according to claim 11, wherein a covering range of the reflective layer is equal to, or greater than a covering range of the adhering layer.

14. The light guiding membrane switch according to claim 11, wherein the adhering layer is a transparent adhesive medium or a light-color adhesive medium.

15. The light guiding membrane switch according to claim 11, wherein the lower membrane layer comprises a first through hole, the upper membrane layer comprises a second through hole, the first through hole, the second through hole, and the via hole of the light guiding spacing layer correspond to each other.

16. The light guiding membrane switch according to claim 11, wherein the lower membrane layer comprises a first trigger point, the upper membrane layer comprises a second trigger point corresponding to the first trigger point, and the via hole correspond to the first trigger point and the second trigger point.

17. The light guiding membrane switch according to claim 11, wherein the lower membrane layer further comprises a light reflection layer on a surface thereof which faces the light guiding spacing layer.

18. The light guiding membrane switch according to claim 11, further comprising a second adhering layer and a second reflective layer, wherein the second reflective layer is securely fastened on the lower surface of the light guiding spacing layer, and the second adhering layer is adhered between the second reflective layer and the lower membrane layer.

* * * * *